United States Patent [19]

Woebcke et al.

[11] Patent Number: 4,732,740

[45] Date of Patent: Mar. 22, 1988

[54] INTEGRATED HEAVY OIL PYROLYSIS PROCESS

[75] Inventors: Herman H. Woebcke, Barnstable; Swami Narayanan, Westwood, both of Mass.; Axel R. Johnson, North Babylon, N.Y.

[73] Assignee: Stone & Webster Engineering Corporation, Boston, Mass.

[21] Appl. No.: 658,474

[22] Filed: Oct. 9, 1984

[51] Int. Cl.[4] ..... C10G 9/14

[52] U.S. Cl. ..... 422/193; 422/188; 422/197; 422/204

[58] Field of Search ..... 422/196, 197, 188, 204, 422/193, 194; 585/324; 208/72

[56] References Cited

U.S. PATENT DOCUMENTS

| | | | |
|---|---|---|---|
| 2,149,860 | 3/1939 | Morrell | 208/72 |
| 2,289,839 | 7/1942 | Herthel | 208/72 |
| 2,535,418 | 12/1950 | Holland . | |
| 2,642,466 | 6/1953 | Garner et al. . | |
| 2,666,022 | 1/1954 | Johnson . | |
| 2,723,948 | 11/1955 | McCurdy . | |
| 3,579,438 | 5/1971 | Cruse | 208/130 |
| 3,862,898 | 1/1975 | Boyd et al. . | |
| 4,065,379 | 12/1977 | Soonawala et al. | 585/324 |
| 4,162,290 | 7/1979 | Crawford et al. | 422/204 |
| 4,426,278 | 1/1984 | Kosters | 208/132 |

FOREIGN PATENT DOCUMENTS

| | | | |
|---|---|---|---|
| 65203 | 5/1977 | Japan | 585/648 |

OTHER PUBLICATIONS

Achilladelis, B., Chemistry and Industry, Apr. 1978, "History of UOP".

*Primary Examiner*—Barry S. Richman
*Assistant Examiner*—William R. Johnson
*Attorney, Agent, or Firm*—Hedman, Gibson, Costigan & Hoare

[57] ABSTRACT

An apparatus for the cracking of a heavy hydrocarbon feedstock comprising a pre-pyrolysis cracker for treating the feedstock at elevated temperatures and pressures; a primary separator for separating the effluent from the pre-pyrolysis cracker into a heavy fuel oil fraction and a treated heavy hydrocarbon fraction; a pyrolysis furnace having a convection section for preheating and two radiant sections for partially cracking the treated heavy hydrocarbon and cracking a light hydrocarbon feedstock, a DUOCRACKER for completely cracking the heavy fraction while quenching the light fraction and a quencher for quenching the composite stream from the DUOCRACKER.

1 Claim, 1 Drawing Figure

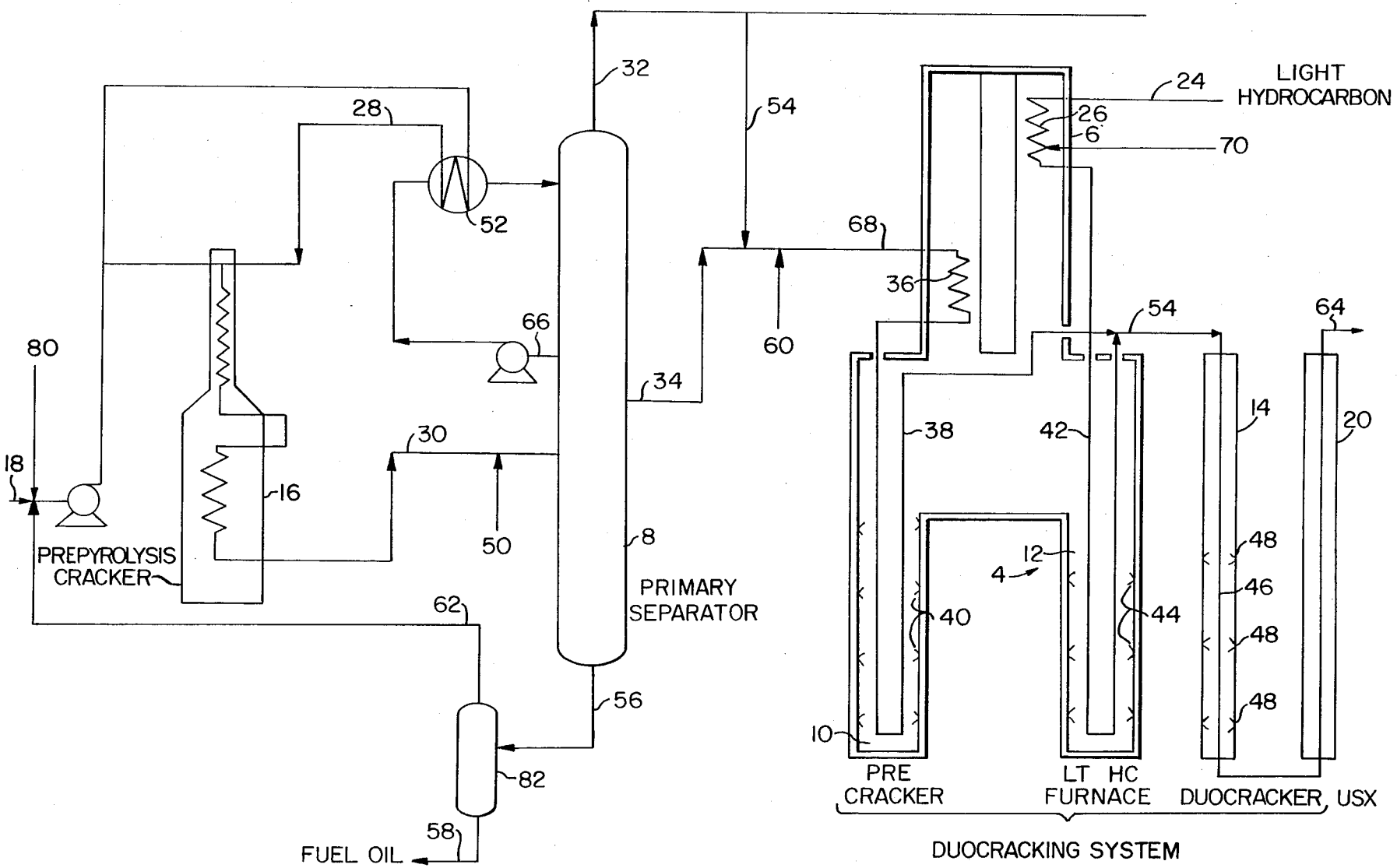
LIGHT HYDROCARBON
DUOCRACKER USX
LT HC FURNACE
PRE CRACKER
DUOCRACKING SYSTEM
PRIMARY SEPARATOR
PREPYROLYSIS CRACKER
FUEL OIL

INTEGRATED HEAVY OIL PYROLYSIS PROCESS

BACKGROUND OF THE INVENTION

1. Field of the Invention

This invention relates to the production of olefins from hydrocarbon feedstock. More particularly, the invention relates to the production of olefins from heavy hydrocarbon feedstocks. Most specifically, the invention relates to the production of olefins from heavy hydrocarbon feedstocks by a combination of pretreatment of the heavy hydrocarbon feedstock in which a liquid fuel product first is produced as a method of preferentially rejecting carbon to enhance the production of olefins ultimately converted from the hydrocarbon feedstock.

2. Description of the Prior Art

The petrochemical industry has long used naturally forming hydrocarbon feedstocks for the production of valuable olefinic materials, such as ethylene and propylene. Ideally, commercial operations have been carried out using normally gaseous hydrocarbons such as ethane and propane as the feedstock. As the lighter hydrocarbons have been consumed and the availability of the lighter hydrocarbons has decreased, the industry has been required to crack heavier hydrocarbons. Hydrocarbons such as naphtha and atmospheric gas oil (AGO) which have higher boiling points than the gaseous hydrocarbons have been used commercially. Processes are under development for the use of still heavier, less expensive feeds such as vacuum gas oil (VGO) or residues from atmospheric distillation columns, commonly called atmospheric tower bottoms (ATB). However, none of these processes using feeds with normal boiling points above 650° F. have achieved broad commercial success. The major impediment to the use of feeds heavier than AGO has been the need to increase the quantity of dilution steam necessary to inhibit coke formation. A further problem results from the need to dispose of increasing yields of the poor quality fuel oil by-product of the olefin producing process when the heavy hydrocarbons are used as feedstock.

A typical process for the production of olefins from naturally forming hydrocarbon feedstocks is the thermal cracking process.

Illustratively, process fired heaters are used to provide the requisite heat for the reaction. The feedstock flows through a plurality of coils within the fired heater, the coils being arranged in a manner that maximizes the heat transfer to the hydrocarbon flowing through the coils. In conventional coil pyrolysis, dilution steam is used to inhibit coke formation in the cracking coil. A further benefit of high steam dilution is the inhibition of the coke deposition in the exchangers used to rapidly quench the cracking reaction. An illustration of the conventional process is seen in U.S. Pat. No. 3,487,121 (Hallee). More recently, the thermal cracking process has been conducted in apparatus which allow the hydrocarbon feedstock to pass through a reactor in the presence of steam while providing for heated solids as the heat carrier.

The use of steam in the hydrocarbon stream requires larger furnace capacity and equipment than would be necessary for the hydrocarbon without steam. Further, when steam is used, energy and equipment must be provided to generate and superheat the steam.

In the production of olefins from hydrocarbon feedstocks the generation of coke has been a problem regardless of the process used. Typically, the cracking reaction will cause production of heavy tar and coke materials which foul the equipment and provide no useful function. The problem is particularly acute in the coil cracking environment where the furnaces must be taken from service to remove the coke and tar from the coils to enable the process to continue efficiently.

The use of heavier hydrocarbon feedstocks, such as residual oils with the attendant high asphaltene and coke precursor content, intensifies and magnifies the problem of coke formation and the associated equipment fouling problems in coil processes. To compensate, the steam rate must be increased, which would increase the specific energy, i.e., energy consumed per unit of ethylene/olefins produced. When using VGO as a feedstock, for example, the specific energy can be 50% above that needed for a light hydrocarbon such as naphtha. Similarly, the amount of ethylene that can be produced from a given size pyrolysis coil when using VGO is often less than half that obtained from naphtha.

Another problem attendant to the use of higher boiling range feedstocks is the increased production of poorer quality fuel oil. The cracking severity needed to produce olefins from these heavy feeds is much higher than that used for conventional thermal crackers designed to produce gasoline and fuel oil. This high severity results in the simultaneous production of olefins and poor quality fuel oil rich in asphaltenes and free carbon.

All of the above problems have detracted from the use of high boiling, less expensive feeds for producing olefins.

A variety of attempts have been made to pretreat the heavy hydrocarbon feedstock to render it suitable for thermal cracking. Hydro-treating of the feedstock is one effort. Another effort, is the vaporization of the feedstock with large quantities of steam to create a very low system partial pressure (Gartside, U.S. Pat. No. 4,264,432). Others have proposed solvent extraction pretreatment of the hydrocarbon to remove the asphaltene and coke precursors. Another attempt is the thermal pretreatment of resids to yield a heavy hydrocarbon, then catalytically hydrotreating a portion of the heavy hydrocarbon feedstock before the steam cracking step (U.S. Pat. No. 4,065,379, Soonawala, et al.) and similarly, the pre-treatment of hydrocarbon feedstock by initial catalytic cracking to produce a naphtha or naphtha-like feed for ultimate thermal cracking (U.S. Pat. No. 3,862,898, Boyd, et al.). These processes all improve the cracking of heavy hydrocarbon, however, in most instances the process suffers from either the expense of large steam dilution equipment or the unsatisfactory reduction of tar and coke accumulation in the process equipment.

SUMMARY OF THE INVENTION

It is an object of the present invention to provide a process in which heavy hydrocarbon can be cracked to produce valuable olefins with a minimum of asphaltene and coke generation.

It is another object of the present invention to provide a process in which olefins are produced from heavy hydrocarbon feedstocks with an associated liquid fuel generation step in which the asphaltene precursors are concentrated in the liquid product.

It is a further object of the present invention to provide a process in which heavy hydrocarbons can be cracked to olefins with a minimal amount of dilution steam.

It is a still further object of the present invention to provide a means for integrating a feed pretreatment step with conventional or developmental cracking technologies without incurring additional capital or utility generation expenditures.

To this end, the process proceeds in which the heavy hydrocarbon feedstock is initially pre-treated to temperature levels below that at which significant conversion of the feed to olefins will take place. For example, a temperature of about 750° F. is the pre-heat temperature for vacuum gas oils. The pre-heated feed is then heated in a pre-pyrolysis cracker operated at high pressure, i.e., above 300 psig at the outlet and temperature levels below 1200° F. Thereafter, the hydrocarbon stream is subjected to considerable pressure reduction; i.e., to about 100 psig to cause essentially complete vaporization of all hydrocarbons boiling below about 1000° F. at atmospheric pressure. Thus, separate liquid and vapor fractions are produced in which the heavy liquid fraction is comprised of high boiling polyaromatics produced in the prior process steps, essentially from the coke precursors. The heavy liquid fraction is removed and taken as a fuel and the vapor fraction is passed downstream for conversion to olefins.

The lighter treated heavy hydrocarbon fraction and the light overhead fraction are initially passed through a pre-cracker in which pentane conversion is maintained at lower levels, i.e., approximately 15 to 40 percent equivalent normal pentane conversion. Thereafter, the partially cracked heavy hydrocarbon is passed downsteam for ultimate thermal cracking.

Various conventional thermal cracking processes can be used to complete the olefin producing process, however, the pre-treated hydrocarbon is particularly well suited for final cracking in a DUOCRACKING environment. The basic DUOCRACKING procedure is accomplished by partially cracking a heavy hydrocabon at a low temperature in the presence of a small amount of steam, i.e., less than 0.2 pound of steam per pound of hydrocarbon and thereafter, joining the partially cracked heavy hydrocarbon with a stream of completely cracked lighter hydrocarbon to effect complete cracking of the partially cracked heavy hydrocarbon. U.S. patent application Ser. No. 431,588 illustrates the DUOCRACKING process.

DESCRIPTION OF THE DRAWING

The drawing is an elevational schematic of the process of the present invention shown in a furnace system environment.

DESCRIPTION OF THE PREFERRED EMBODIMENT

As has been previously indicated, the process of the present invention is directed to providing a means for treating heavy hydrocabon feedstocks for the purpose of producing olefins. The heavy hydrocarbons contemplated as the feedstock have an average boiling point above 1000° F. or an average molecular weight above 400. These feedstocks include the high boiling distillate gas oils, atmospheric gas oils, vacuum gas oils, atmospheric tower bottoms and other residual feedstocks. However, it should be noted that the process has general application for cracking hydrocarbons to produce olefins and in particular, in applications in which steam dilution is used to suppress or reduce the formation of asphaltene and coke from the polyaromatics and other coke precursors found in naturally occuring hydrocarbon feedstocks.

As best seen in the drawing, the process of the present invention can be performed in an integrated thermal cracking system incorporating a pre-pyrolysis cracker 16, a primary separator 8, a pyrolysis furnace 4, a DUOCRACKER section 14, and a quench exchanger 20. The pyrolysis furnace 4 includes a convection section 6, a pre-cracker 10 for cracking heavy hydrocarbons, and a radiant section 12 for cracking light hydrocarbons. The quench exchanger 20 can be a conventional pyrolysis quench apparatus such as a USX heat exchanger shown in detail in U.S. Pat. No. 3,583,476 (Woebcke, et al.).

A line 18 is provided for the heavy hydrocarbon feed and a line 24 for a light hydrocarbon feed is also provided. The heavy hydrocarbon line 18 is arranged to pass through a heat exchanger 52 located in the wash section of the primary separator 8. Similarly, the light hydrocarbon line 24 is arranged to pass through a coil 26 in the convection section 6 of the pyrolysis furnace 4. A steam line 70 is arranged to deliver steam to the light hydrocarbon feed line 24. A line 28 is provided to deliver the preheated heavy hydrocarbon to the prepyrolysis cracker 16 and a line 30 is provided to deliver the pre-pyrolysis cracked feedstock from the pre-pyrolysis cracker 16 to the primary separator 8. A steam line 50 is arranged to deliver steam to the pre-pyrolysis cracked feedstock in line 30 if desired. The primary separator 8 is provided with an effluent line 34 for the lighter treated heavy hydrocarbon feedstock to be passed downstream for further processing to olefins. The primary separator 8 is provided with an overhead line 32 for the lighter overhead fraction, to be provided as feed for the light hydrocarbon cracking furnace through line 24, if desired or as feed to the lighter treated heavy hydrocarbon line 34 through line 54. Line 60 is arranged to deliver steam to the lighter treated heavy hydrocarbon feed line 34.

The primary separator 8 is further provided with a line 56 from which the heavy liquid material is taken in the form of a fuel oil.

Coils 36 are provided in the convection section 6 of the pyrolysis furnace 4 to further heat the lighter treated heavy hydrocarbon feedstock and optionally the light overhead fraction from the primary separator 8 and a radiant coil 38 is provided in the pre-cracker 10 for partially cracking the lighter treated heavy hydrocarbon feedstock.

The pre-cracker 10 is also provided with conventional burners shown illustratively as 40. Similarly, the light hydrocarbon cracking section 12 is a radiant section provided with a coil 42 and conventional radiant burners 44. An effluent discharge line 54 is provided in which the partially cracked heavy hydrocarbon stream and the cracked light hydrocarbon stream combine prior to being fed to the single coil 46 in the DUOCRACKER 14. Again, conventional radiant burners 48 are provided in the DUOCRACKER section 14.

In essence, the process of the present invention is conducted by delivering a heavy hydrocarbon feedstock through line 18 to the heat exchanger 52 wherein the temperature of the heavy hydrocarbon is elevated to about 750° F. Optionally, steam is delivered through a steam line 80 to the heavy hydrocarbon feedstock in line 18. The heated hydrocarbon is delivered to the prepyrolysis cracker 16 through line 28 wherein a pressure in the range of 150 psig to 400 psig, preferably above 200 psig and most preferably above 300 psig is maintained at the outlet. A residence time of 0.5 to 3 minutes for the hydrocarbon in the pre-pyrolysis cracker 16 is required. The outlet temperature of the pre-pyrolysis cracker 16 is below 1200° F., preferably above 950° F., i.e., 950° F. to 990° F. The pre-pyrolysis cracked hydrocarbon feedstock is discharged through line 30 where it is subjected to considerable pressure reduction by conventional means then fed to the primary separator 8.

Practice has shown that a pressure reduction of the pre-pyrolysis cracked feedstock stream to approximately 100 psig prior to being fed to the primary separator 8 is desirable.

The primary separator 8 is a conventional device such as a cyclone or a fractionation column. The separation of the pre-pyrolysis cracked feedstock in the primary separator 8 occurs at about 100 psig. The primary separator 8 is provided with.reflux means shown as line 66, which recycles a liquid cut through the heat exchanger 52, and back to the primary separator 8. The reflux stream is at a temperature of about 800° F. and provides a wash for the primary separator 8 to insure a light overhead fraction with a minimun of entrained polyaromatics.

The pre-pyrolysis cracked feedstock is separated into several fractions in the primary separator 8; i.e., a heavy fuel oil fraction, a lighter treated heavy hydrocarbon fraction and a light overhead fraction each of which exits the primary separator 8 at about 100 psig.

The heavy fuel oil fraction leaving the primary separator 8 through line 56 is rapidly quenched to a temperature below 900° F., preferably below 850° F. The heavy fuel oil fraction is delivered to a stripper 82, where a heavy hydrocarbon fraction is separated from the heavy fuel oil fraction and recycled to the heavy hydrocarbon feedstock line 18 through the line 62.

Typically, the heavy fuel oil fraction leaving the stripper 82, through line 58 will have an asphaltene concentration of 1.5 to 5 weight percent, preferably less than 2 weight percent and a hydrogen concentration of 6.0 to 8.5 weight percent, preferably below 7.0%. The heavy fuel oil fraction will also contain at least 80 weight percent of the asphaltene precursors found in the original feedstock, preferably over 90 weight precent.

The heavy fuel oil fraction may be cut with recycled stock depending of the characteristics of the fuel desired.

The lighter treated heavy hydrocarbon fraction taken through the line 34 from the side of the separator is a hydrocarbon boiling in the range between 450° F. and fuel oil (I.B.P. 650° F. to 950° F.) and will exit the primary separator 8 at a temperature of about 400° F. to 700° F. The light overhead fraction taken overhead through the line 32 from the primary separator 8 is a hydrocarbon fraction boiling at 450° F. and below (450° F.−). and exits the primary separator 8 at about 700° F. to 1000° F. Typically, the combined lighter treated heavy hydrocarbon fraction and the light overhead fraction exiting the primary separator 8 will have a hydrogen concentration of over 17 weight percent and an asphaltene precursor concentration below 100 ppm.

The lighter treated heavy hydrocarbon fraction is particularly well suited for cracking in the heavy hydrocarbon cracking furnace side of the DUOCRACKING system. The light overhead fraction can be cracked either as a light hydrocarbon or as a heavy hydrocarbon and thus may be delivered to either the light hydrocarbon cracking furnace side of the DUOCRACKING system or to the heavy hydrocarbon cracking furnace side of the DUOCRACKING system. It is contemplated that if DUOCRACKING is used to crack the treated heavy hydrocarbon of the process, the light overhead fraction taken through line 32 will be used as the feed for the light hydrocarbon cracking furnace side of the DUOCRACKING process if a naturally occurring light hydrocarbon is unavailable.

Dilution steam is delivered at the rate of 0.2 pound of steam per pound of hydrocarbon feed or less through line 60 to line 68, through which the lighter treated heavy hydrocarbon fraction and optionally the light overhead fraction flow.

The lighter treated heavy hydrocarbon fraction passes through the convection coil 36 and enters the pre-cracker 10 at about 840° F. to 1110° F., and usually 950° F. The temperature in the pre-cracker 10 is in the range of 950° F. to 1400° F. and the residence time is between 0.05 to 0.2 seconds, with the coil outlet temperature preferably in the range of 1350° F. The conditions in the pre-cracker 10 are selected to maintain a cracking severity of below 15 to 40 percent equivalent normal pentane conversion. The effluent from the pre-cracker 10 is thus characterized as a partially cracked heavy hydrocarbon.

The light hydrocarbon cracking furnace 12 will operate in a conventional manner with coil outlet temperatures as high as 1600° F., residence time of 0.1 to 0.5 seconds and 0.3 to 0.6 pound of dilution steam per pound of hydrocarbon. The light hydrocarbon feedstocks contemplated are ethane, propane, normal and iso-butane, propylene mixtures thereof, raffinates or naphthas. The conversion to olefins of the light hydrocarbons in the light hydrocarbon cracking furnace 12 is intended to be the maximum achievable and the effluent discharging from the furnace 12 is thus characterized as a completely cracked light hydrocarbon.

The partially cracked heavy hydrocarbon effluent stream is delivered to the common line 54 at a temperature in the range of 1300° F. to 1400° F., e.g., 1350° F., and the completely cracked light hydrocarbon effluent stream is delivered to the common line 54 at a temperature of about 1600° F., wherein the streams are mixed. The composite stream passes downstream through a DUOCRACKER coil 46 to effect a complete conversion of the partially cracked heavy hydrocarbon to levels required for commercial yields of olefins. The light hydrocarbon component of the mixed stream in line 54 provides over 80% of the heat to effect complete cracking of the partially cracked heavy hydrocarbon component. Concommitantly, the completely cracked light hydrocarbon effluent is quenched by the lower temperature partially cracked heavy hydrocarbon effluent in the common line 54. The composite effluent product exiting the DUOCRACKER coil 46 is passed downstream and quenched in conventional quenching equipment such as a USX (Double Tube Exchanger) 20. Thereafter, the effluent is separated into the various specific products.

One embodiment of the process of the present invention is shown in the drawing and illustrated by the following example (Table I - A) wherein the process conditions are given and the characteristics of the hydrocarbon product which will be obtained are shown:

TABLE I

EXAMPLES OF PROCESS OF INVENTION

| Example | Line # (see drawing) 18 | 32 | 34 | 54 | 56 | 58 | 62 | 60 | 70 | 80 | 82 | 24 | Ethylene Yield Heavy Wt % | Heavy Pounds | Light Wt % | Light Pounds | Total |
|---|---|---|---|---|---|---|---|---|---|---|---|---|---|---|---|---|---|
| A. Vacuum Gas Oil | | | | | | | | | | | | | | | | | |
| Pressure (psig) | 0 | 100 | 100 | — | 100 | 25 | 25 | — | — | — | — | | | | | | |
| Temperature (°F.) | 300 | — | — | — | 825 | 800 | 800 | — | — | — | — | | | | | | |
| Hydrocarbon Feed (Pounds) | 100 | 36 | 54 | — | 13 | 10 | 3 | 10 | 20 | 0 | 1 | 0 | 20 | 20 | — | — | 20 |
| Normal Boiling Point (°F.) | 650/1100 | 450− | 450/950 | — | 950+ | 1050+ | 850/1050 | — | steam | | — | | | | | | |
| B. Vacuum Gas Oil + Naphtha | | | | | | | | | | | | | | | | | |
| Hydrocarbon Feed (Pounds) | 59 | 54 | 0 | 54 | 6 | 5 | 1 | 10 | 20 | 0 | 1 | 36 | 20 | 10.8 | 30 | 10.8 | 21.6 |
| Normal Boiling Point (°F.) | 650/1100 | 950− | | 950− | 950+ | 1050+ | 850/1050 | — | steam | | — | | | | | | |
| C. Atmospheric Tower Bottoms | | | | | | | | | | | | | | | | | |
| Hydrocarbon Feed (Pounds) | 100 | 40 | 45 | 0 | 20 | 15 | 5 | 4 | 24 | 5 | 1 | 0 | 24 | 24 | — | — | 24 |
| Normal Boiling Point (°F.) | 650+ | | | | 950+ | 1050+ | 850/1050 | — | steam | | — | | | | | | |
| D. Atmospheric Tower Bottoms + Naphtha | | | | | | | | | | | | | | | | | |
| Hydrocarbon Feed (Pounds) | 53 | 45 | 0 | 45 | 11 | 8 | 3 | 6 | 24 | 3 | 1 | 40 | 24 | 12 | 40 | 12 | 24 |
| Normal Boiling Point (°F.) | | 950− | | 950− | 950+ | 1050+ | 850/1050 | — | steam | | — | | | | | | |

When one hundred pounds of an East Texas vacuum gas oil with a normal boiling point range from 650° F. to 1100° F. is to be treated using the process of the present invention, the feedstock at 300° F. and atmospheric pressure is pumped through the heat exchanger 52 of the primary separator 8 , and further heated to about 750° F., then introduced into the pre-pyrolysis cracker at a temperature of about 980° F. and a pressure in the range of 400 psig. The olefin precursors are separated from their aromatic linkages by reducing both the weight and hydrogen concentration in the 1020° F.+ boiling range. Thereafter the pre-pyrolysis cracked feedstock is introduced into the primary separator 8 through a line 30 wherein the pressure is reduced to about 100 psig. The light overhead fraction is introduced through line 32 into line 24 and used as feedstock for the light hydrocarbon cracking furnace. The light overhead fraction of 36 pounds has a normal boiling point of about 450° F. The lighter treated heavy hydrocarbon stream in line 34 has a normal boiling point range of 450° F. to 950° F. This stream is diluted with steam provided by line 60 at a rate of 10 pounds per 54 pounds of hydrocarbon. The resultant diluted lighter treated heavy hydrocarbon stream is further heated in coil 36 of the convection section 6 before being partially cracked in coil 38 of the furnace pre-cracker section 10 at a temperature of about 1350° F. Simultaneously, 36 pounds of light hydrocarbon is preheated in coil 26 and diluted with 20 pounds of steam provided through line 70, then cracked at 1600° F. in coil 42 of light hydrocarbon cracking furnace section 12. The cracked light hydrocarbon from the coil 42 and the partially cracked heavy hydrocarbon from coil 38 are joined in line 54 and delivered to coil 46 of the DUOCRACKER 14 wherein the completely cracked light hydrocarbon is partially quenched and the partially cracked heavy hydrocarbon is further cracked to completion. The resultant product is quenched in quench exchanger 20 and the products separated and analyzed. The ethylene yield attributable to the original 100 pounds of heavy hydrocarbon feed is 20 weight percent.

The heavy fuel oil fraction of 13 pounds exiting the primary separator 8 through line 56 is rapidly quenched to a temperature of about 825° F. The heavy fuel oil fraction is then fed to the stripper 82 where a 3 pound heavy hydrocarbon fraction is separated from the heavy fuel oil fraction and recycled to the heavy hydrocarbon feedstock line 18 through line 62. Ten pounds of the heavy fuel oil fraction is removed through line 58.

Three examples in addition to the previous one are shown in tabular form (Table I). Example B illustrates the effect of the invention on a vacuum gas oil as a heavy hydrocarbon feedstock and a purchased light hydrocarbon (naphtha) as the feedstock for the light hydrocarbon cracking furnace side of the DUOCRACKING process. Example C illustrates the effect of the invention on an atmospheric towers bottom as the heavy hydrocarbon feedstock and dilution steam introduced through line 80 prior to the pre-pyrolysis cracking step. Example D illustrates the effect of the invention on an atmospheric towers bottom as the heavy hydrocarbon feedstock with dilution steam as in Example C and additionally a purchased light hydrocarbon (naphtha) as the feedstock for the light hydrocarbon cracking furnace side of the DUOCRACKING process.

As seen in the foregoing examples, this invention relates generally to a process of improving olefin production from heavy hydrocarbon feedstocks by separating olefin precursors from their aromatic linkages by reducing both the weight and hydrogen concentration in the 1020° F.+ boiling range and thereby forming a carbon rich liquid fuel product.

Specific embodiments of the invention have been described and shown in the examples accompanying drawing to illustrate the application of the inventive principles.

What is claimed is:

1. An apparatus for cracking a heavy hydrocarbon feedstock to produce olefins comprising:

(a) a pre-pyrolysis cracker including means for treating heavy hydrocarbon feedstock at elevated pressures and temperatures;

(b) a primary separator for separating the effluent from the pre-pyrolysis cracker into a heavy fuel oil fraction and a treated heavy hydrocarbon fraction;

(c) a pyrolysis furnace having means defining a convection section for preheating the treated heavy hydrocarbon fraction from the primary separator and for preheating a light hydrocarbon feedstock, means defining a first radiant section for partially cracking the treated heavy hydrocarbon fraction, and means defining a second and radiant section for cracking the light hydrocarbon feedstock;

(d) means defining a DUOCRACKER for completely cracking the partially cracked heavy hydrocarbon stream emanating from the pyrolysis furnace while quenching the cracked light hydrocarbon stream from the pyrolysis furnace; and (e) a quencher for quenching the composite stream of heavy and light hydrocarbons from the DUOCRACKER to terminate the reactions.

* * * * *